US010942465B2

(12) United States Patent
Kototani et al.

(10) Patent No.: US 10,942,465 B2
(45) Date of Patent: Mar. 9, 2021

(54) TONER

(71) Applicant: CANON KABUSHIKI KAISHA, Tokyo (JP)

(72) Inventors: Shohei Kototani, Suntou-gun (JP); Kentaro Yamawaki, Mishima (JP); Koji Abe, Numazu (JP); Tomonori Matsunaga, Suntou-gun (JP); Masamichi Sato, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/600,673

(22) Filed: Oct. 14, 2019

(65) Prior Publication Data

US 2020/0124998 A1 Apr. 23, 2020

(30) Foreign Application Priority Data

Oct. 19, 2018 (JP) ..... JP2018-197730

(51) Int. Cl.
*G03G 9/093* (2006.01)
*G03G 9/08* (2006.01)
*G03G 9/087* (2006.01)

(52) U.S. Cl.
CPC ..... *G03G 9/09328* (2013.01); *G03G 9/0821* (2013.01); *G03G 9/0825* (2013.01); *G03G 9/08702* (2013.01)

(58) Field of Classification Search
CPC ..... G03G 9/09328; G03G 9/097; G03G 9/08782; G03G 9/0821
See application file for complete search history.

(56) References Cited

U.S. PATENT DOCUMENTS 5,853,939 A * 12/1998 Yanagibori ..... G03G 9/08708 430/108.1
6,500,593 B2 12/2002 Abe et al.
(Continued)

FOREIGN PATENT DOCUMENTS

| | | |
|---|---|---|
| JP | 2001-075304 | 3/2001 |
| JP | 2010-145994 | 7/2010 |
| JP | 6020458 | 10/2016 |

OTHER PUBLICATIONS

U.S. Appl. No. 16/670,352, Kentaro Kamae, filed Oct. 31, 2019.
(Continued)

*Primary Examiner* — Christopher D Rodee
(74) *Attorney, Agent, or Firm* — Venable LLP

(57) ABSTRACT

A toner comprising a toner particle that contains a binder resin and a wax; in a microcompression test under a maximum load condition of $1.1\times10^{-3}$ N, a force applied to the toner particle when a percentage deformation of the toner particle with reference to a number-average particle diameter of the toner particle at 25° C. reaches 15% is 0.10 to 1.00 mN and the force applied to the toner particle when the percentage deformation at 45° C. reaches 15% is 0.10 to 0.40 mN; and when the force applied to the toner particle is a variable and the percentage deformation of the toner particle is from 15 to 30%, the rate of increase in the percentage deformation of the toner particle at 25° C. and the rate of increase in the percentage deformation of the toner particle at 45° C. satisfy specific formula.

7 Claims, 1 Drawing Sheet

(56) References Cited

U.S. PATENT DOCUMENTS

| | | | |
|---|---|---|---|
| 7,300,737 | B2 | 11/2007 | Ayaki et al. |
| 7,459,253 | B2 | 12/2008 | Abe et al. |
| 7,704,661 | B2 | 4/2010 | Ikeda et al. |
| 8,053,156 | B2 | 11/2011 | Abe et al. |
| 8,084,177 | B2 | 12/2011 | Zhou et al. |
| 8,084,178 | B2 | 12/2011 | Tosaka et al. |
| 8,247,147 | B2 | 8/2012 | Abe et al. |
| 8,367,289 | B2 | 2/2013 | Isono et al. |
| 8,497,054 | B2 | 7/2013 | Sugiyama et al. |
| 8,652,737 | B2 | 2/2014 | Handa et al. |
| 9,170,509 | B2 | 10/2015 | Masuda |
| 9,341,967 | B2 | 5/2016 | Tsujino et al. |
| 9,366,981 | B2 | 6/2016 | Yamawaki et al. |
| 9,632,441 | B2 | 4/2017 | Abe et al. |
| 9,658,551 | B2 | 5/2017 | Terui et al. |
| 9,733,583 | B2 | 8/2017 | Kuroki et al. |
| 9,733,584 | B2 | 8/2017 | Masumoto et al. |
| 9,785,077 | B2 | 10/2017 | Abe et al. |
| 9,897,933 | B2 | 2/2018 | Yoshida et al. |
| 10,429,757 | B2 | 10/2019 | Yoshida et al. |
| 10,503,090 | B2 | 12/2019 | Tominaga et al. |
| 10,545,422 | B2 | 1/2020 | Yamawaki et al. |
| 2015/0099224 | A1* | 4/2015 | Abe ..... G03G 9/09328 430/110.2 |
| 2019/0332024 | A1* | 10/2019 | Umeda ..... G03G 9/0806 |
| 2020/0026208 | A1 | 1/2020 | Terui et al. |
| 2020/0026209 | A1 | 1/2020 | Yagi et al. |

OTHER PUBLICATIONS

U.S. Appl. No. 16/728,050, Tsuneyoshi Tominaga, filed Dec. 27, 2019.
U.S. Appl. No. 16/728,060, Kentaro Yamawaki, filed Dec. 27, 2019.
U.S. Appl. No. 16/728,101, Taiji Katsura, filed Dec. 27, 2019.
U.S. Appl. No. 16/728,122, Masamichi Sato, filed Dec. 27, 2019,
U.S. Appl. No. 16/728,151, Masatake Tanaka, filed Dec. 27, 2019.
U.S. Appl. No. 16/728,157, Shohei Kototani, filed Dec. 27, 2019.

* cited by examiner

TONER

BACKGROUND OF THE INVENTION

Field of the Invention

The present invention relates to a toner used in image-forming methods such as, e.g., electrophotographic methods, electrostatic recording methods, and toner jet methods.

Description of the Related Art

Methods in which image information is visualized via an electrostatic latent image, for example, electrophotographic methods, are used in copiers, multifunction machines, and printers. There has been demand in recent years for even higher speeds and lower power consumption from multifunction machines and printers, and the development is required of toner that exhibits a high stability whereby the image quality does not decline even at higher speeds and higher print percentages, and that exhibits an excellent low-temperature fixability whereby image fixing can be carried out at lower energies. Thus, the development is required of a toner that exhibits an excellent development durability not subject to deterioration even when challenged by higher print speeds and multisheet copying, and that exhibits an excellent low-temperature fixability whereby image defects are not produced even when the fixation temperature is reduced.

In order to improve the development durability, for example, Japanese Patent Application Laid-open No. 2001-75304 proposes a polymerized toner that has a coating layer formed by the adhesion of silicon compound-containing particulate masses with each other.

In addition, with the goal of improving the flowability and aggregation behavior of toners, Japanese Patent Application Laid-open No. 2010-145994 proposes a toner that contains a polyhedral oligomeric silsesquioxane compound.

In order to improve the low-temperature fixability, for example, Japanese Patent No. 6,020,458 proposes a toner that uses an ester wax as a softening agent.

SUMMARY OF THE INVENTION

However, with respect to the toner described in Japanese Patent Application Laid-open No. 2001-75304, the production of bleed, in which release agent and resin components exude out from the gaps in the silicon compound-containing particle masses, and the amount of silane compound deposition on the toner particle surface and/or hydrolysis and condensation of the silane compound are unsatisfactory. As a consequence, further improvements with respect to the development durability and environmental stability are required of the toner described in this reference.

In addition, with respect to the toner described in Japanese Patent Application Laid-open No. 2010-145994, the mechanical strength of the polyhedral oligomeric silsesquioxane incorporated in the toner is still inadequate and further improvements are required with respect to the development durability.

With respect to the ester wax used in the toner described in Japanese Patent No. 6,020,458, during the toner production process a portion of the ester wax can become miscibilized as such in the binder resin, and as a result there is room for additional improvements in the mechanical strength of the toner.

An object of the present invention is to provide a toner that exhibits a better development durability and low-temperature fixability than conventional toners. Thus, an object is to provide a toner that resists streak and ghost production even at high speeds and high print percentages and that exhibits an excellent low-temperature fixability whereby image defects are not produced even when the fixation temperature is lowered.

The aforementioned object is achieved by the present invention described as follows.

That is, a toner of the present invention is a toner comprising a toner particle, wherein the toner particle contains a binder resin and a wax;

in a measurement performed in a microcompression test under a maximum load condition of $1.1\times10^{-3}$ N, a force applied to the toner particle when a percentage deformation of the toner particle with reference to a number-average particle diameter of the toner particle at 25° C. reaches 15% is from 0.10 mN to 1.00 mN and the force applied to the toner particle when the percentage deformation at 45° C. reaches 15% is from 0.10 mN to 0.40 mN; and when the force applied to the toner particle is a variable and the percentage deformation of the toner particle is from 15% to 30%, the rate of increase in the percentage deformation of the toner particle at 25° C., designated as A, and the rate of increase in the percentage deformation of the toner particle at 45° C., designated as B, satisfy the following formula (1):

$$50 \leq B - A \leq 200 \quad (1).$$

The present invention can thus provide a toner having an excellent development durability and an excellent low-temperature fixability. That is, the present invention can provide a toner that resists streak and ghost production even at high speeds and high print percentages and that exhibits an excellent low-temperature fixability whereby image defects are not produced even when the fixation temperature is lowered.

Further features of the present invention will become apparent from the following description of exemplary embodiments with reference to the attached drawings.

DESCRIPTION OF THE EMBODIMENTS

Figure 1:
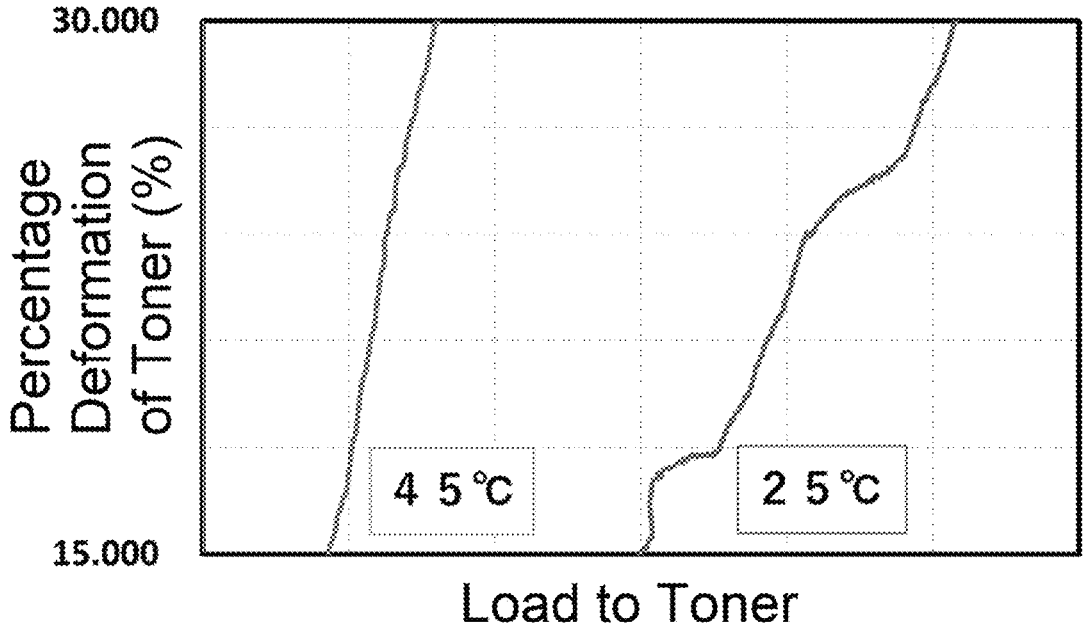
FIG. 1 is a schematic diagram of a load-versus-percentage deformation curve.

Unless specifically indicated otherwise, the expressions "from XX to YY" and "XX to YY" that show numerical value ranges refer in the present invention to numerical value ranges that include the lower limit and upper limit that are the end points.

The present invention is described in detail in the following.

A toner of the present invention is a toner comprising a toner particle, wherein the toner particle contains a binder resin and a wax;

in a measurement performed in a microcompression test under a maximum load condition of $1.1\times10^{-3}$ N, a force applied to the toner particle when a percentage deformation of the toner particle with reference to a number-average particle diameter of the toner particle at 25° C. reaches 15% is from 0.10 mN to 1.00 mN and the force applied to the toner particle when the percentage deformation at 45° C. reaches 15% is from 0.10 mN to 0.40 mN; and when the force applied to the toner particle is a variable and the percentage deformation of the toner particle is from 15% to 30%, the rate of increase in the percentage deformation of the toner particle at 25° C., designated as A, and the rate of increase in the percentage deformation of the toner particle at 45° C., designated as B, satisfy the following formula (1):

$$50 \leq B - A \leq 200 \quad (1).$$

The reason for specifying the force applied to the toner particle when the percentage deformation of the toner particle with reference to the number-average particle diameter of the toner particle reaches 15% in the aforementioned measurement performed in a microcompression test under a maximum load condition of $1.1\times10^{-3}$ N, is that toner begins to undergo plastic deformation in the vicinity of this percentage deformation reaching 15%. The reason for specifying the force applied to the toner particle when this percentage deformation reaches 30% is that the percentage deformation of toner that has gone through the fixing process in image formation is about 30%.

25° C. and 45° C. were selected as the measurement temperatures in the microcompression test for the following reasons.

Since the temperature environment in an office is about 25° C., it is thought that the stress received by the toner during the development process in an office environment is reproduced by using 25° C. for the measurement temperature in the microcompression test. In addition, the stress received by the toner during the fixing process in image formation is thought to be reproduced if, when 45° C. is used for the measurement temperature in the microcompression test, the force applied to the toner particle when the percentage deformation of the toner particle reaches 15% is 0.10 mN to 0.40 mN.

This is because the pressure experienced by one particle of toner in the fixing process approximately corresponds to the pressure experienced by one particle of toner in the aforementioned microcompression test and because the total amount of heat applied to the toner during the measurement approximately corresponds to the amount of heat instantaneously applied to the toner during fixation.

The force applied to the toner particle when a percentage deformation of the toner particle with reference to a number-average particle diameter of the toner particle at 25° C. reaches 15% in the measurement performed in the microcompression test under a maximum load condition of $1.1\times10^{-3}$ N, is preferably from 0.20 mN to 0.70 mN and is more preferably from 0.30 mN to 0.60 mN.

The force applied to the toner particle when the percentage deformation of the toner particle with reference to the number-average particle diameter of the toner particle at 45° C. reaches 15% in the measurement performed in the microcompression test under a maximum load condition of $1.1\times10^{-3}$ N, is preferably from 0.10 mN to 0.30 mN.

The extent to which force is applied to the toner particle such that the percentage deformation reach 15% under the prescribed conditions at 25° C. or 45° C. can be adjusted as appropriate by changing the type and number of parts of the wax and the type of organosilicon compound, infra.

Requiring that formula (1) be satisfied means that, at the point at which the toner begins to undergo plastic deformation, the rate of increase B at 45° C. is controlled into a suitably large range with respect to the rate of increase A at 25° C.

When, with conventional toners, the effort has been made to secure durability in the development step, this has worked to impede collapse during the fixing step due to an excessive hardness and in some cases fixability could not be secured. The toner according to the present invention can assume a suitable hardness in correspondence to the heat received in the particular step.

If, for the rate of increase A in the deformation percentage of the toner particle at 25° C. and the rate of increase B in the deformation percentage of the toner particle at 45° C., the difference B−A is at least 50, a hardness is maintained that can secure durability in the developing step, in which heat is not applied, while a hardness can be exhibited in the fixing step, in which heat is applied, that facilitates collapse and can secure fixability. When, on the other hand, the difference B−A is not more than 200, excessive collapse during the fixing step is suppressed and as a consequence the occurrence of attachment to the fixing member and so forth is impeded. The difference B−A is preferably 70 to 190 and is more preferably 80 to 180.

In order for the toner particle to satisfy formula (1), a soft toner structure is preferred in which the surface layer of the toner particle is hard while the interior of the toner particle has a sharp melt property. In order to obtain such a toner particle, a toner is provided in which the low-temperature fixability is secured by the use of a wax. This wax is preferably an ester wax having a high plasticity for the binder resin and used as a softening agent.

With such a toner, by securing the development durability by forming a toner surface layer with a material having a suitable hardness, e.g., an inorganic material, low-temperature fixability and a high development durability can both be achieved. The inorganic material forming the toner surface layer can be exemplified by organosilicon polymers.

The rates of increase A and B can be adjusted as appropriate, for example, by changing the type and number of parts of the wax and by changing the type of organosilicon compound, infra.

The rate of increase B is preferably 150 to 250 and is more preferably 170 to 240. When the rate of increase B is in the indicated range, toner particle deformation in the fixing process is then maintained in a more advantageous range and as a consequence the low-temperature fixability and releasability during fixation are further enhanced.

In addition, the toner particle preferably has a Martens hardness, measured in a microcompression test under a maximum load condition of $2.0\times10^{-4}$ N, of from 200 MPa to 1100 MPa, while a more preferred range for the Martens hardness is 300 MPa to 900 MPa. By having this Martens hardness be 200 MPa to 1100 MPa, the abrasion resistance of the toner in the developing section is improved over that of conventional toners and the development durability is further enhanced. This serves to increase the freedom in process design in pursuit of higher speeds and higher image qualities and thus can broaden the selection window with regard to, e.g., increasing the regulating blade nip width, increasing the rotation velocity of the developing roller, increasing the carrier mixing stirring rate, and so forth. As a result, a toner can be provided that resists streak generation even during high-speed continuous printing at high print percentages.

The following method is an example of one means for adjustment into the aforementioned prescribed hardness range: formation of a surface layer on the toner particle of a material having a favorable hardness, e.g., an inorganic material, and control of the chemical structure and macrostructure of the surface layer so as to provide a favorable hardness.

Adjustment of the chemical structure, e.g., crosslinking, the degree of polymerization, and so forth, of the material present in the surface layer is an example of means for adjusting the Martens hardness by control of the chemical structure of the toner particle surface layer. Adjustment of the shape of the unevenness of the toner particle surface layer and adjustment of the network structure of protrusion-to-protrusion connections are examples of means for adjusting the Martens hardness through control of the macrostructure of the toner particle surface layer. For the case of use of an organosilicon polymer, infra, for the toner particle surface layer, these adjustments can be accessed through appropriate changes in, e.g., the pH, concentration, temperature, and time during pretreatment with the organosilicon polymer. In addition, the chemical structure and macrostructure may be adjusted also through appropriate alterations of, e.g., the timing and reaction temperature for formation of the organosilicon polymer surface layer on the core particle for the toner particle and through appropriate alterations of, e.g., the shape and concentration of the organosilicon polymer.

The constituent components of the toner particle and the toner are described in the following.

The toner particle contains a binder resin. There are no particular limitations on the binder resin that is used. Specific examples of the binder resin are, for example, styrene resins, acrylic resins, styrene-acrylic resins, polyethylene resins, polyethylene-vinyl acetate resins, vinyl acetate resins, polybutadiene resins, phenolic resins, polyurethane resins, polybutyral resins, and polyester resins. For example, styrene resins, acrylic resins, and styrene-acrylic resins are preferred among the preceding based on a consideration of toner properties.

A single one of these binder resins may be used by itself or a mixture of two or more may be used.

The toner particle contains a wax.

There are no particular limitations on the wax that may be used. The wax can be specifically exemplified by petroleum waxes, e.g., paraffin waxes, microcrystalline waxes, and petrolatum, and derivatives thereof, montan wax and derivatives thereof; hydrocarbon waxes provided by the Fischer-Tropsch process, and derivatives thereof; polyolefin waxes, e.g., polyethylene waxes and polypropylene waxes, and derivatives thereof; natural waxes, e.g., carnauba wax and candelilla wax, and derivatives thereof; higher aliphatic alcohols; fatty acids such as stearic acid and palmitic acid; acid amide waxes; hardened castor oil and derivatives thereof; plant waxes; and animal waxes. Paraffin waxes and hydrocarbon waxes are preferred among the preceding because they provide an excellent releasability.

The wax is preferably an ester wax in terms of the balance between development durability and low-temperature fixability, and esters waxes having the structure indicated by the following formula (3) or formula (4) are more preferred.

(3)

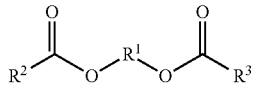

(4)

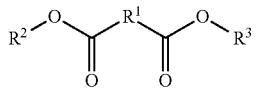

Where, $R^1$ represents an alkylene group having from 1 to 6 carbons, $R^2$ and $R^3$ represent linear alkyl groups having from 11 to 25 carbons, and $R^2$ and $R^3$ are independent of each other. The number of carbons in $R^1$ is preferably from 1 to 5, and the number of carbons in $R^2$ and $R^3$ is preferably from 12 to 24.

Specific examples of ester waxes having a structure represented by formula (3) or formula (4) are, for example, ethylene glycol distearate, ethylene glycol dipalmitate, distearyl sebacate, and dibehenyl adipate.

A single one of these waxes may be used by itself or a mixture of two or more may be used.

The content of the wax (preferably an ester wax having a structure given by formula (3) or formula (4)) with reference to the total mass of the toner particle is preferably from 5.0 mass % to 32.0 mass % and more preferably from 7.0 mass % to 25.0 mass %. The balance among the effects on the development durability, low-temperature fixability, and transferability is enhanced when the wax content is in the indicated range.

The toner particle preferably has a surface layer that contains an organosilicon polymer. A toner particle having an organosilicon polymer-containing surface layer has a favorable hardness from the standpoint of the development durability and low-temperature fixability. As a consequence, the presence of this surface layer can provide a toner particle having an even better low-temperature fixability and development durability.

In addition, ester waxes generally have a high plasticizing action for the binder resin and are used as softening agents. While the low-temperature fixability is further improved when an ester wax is used as a softening agent, during the toner production process, on the other hand, a portion of the ester wax can become miscibilized as such in the binder resin, thus causing a high durability performance to be lost. The development durability and low-temperature fixability can together both be brought to higher levels by using an organosilicon polymer in combination with an ester wax having a structure indicated by formula (3) or (4), which is thus particularly preferred.

Organosilicon polymers are a specific example of a material that can have the prescribed hardness indicated above. The toner particle preferably has a surface layer that contains an organosilicon polymer, and the number of carbon atoms directly bonded to the silicon atom in this organosilicon polymer is preferably one to three (preferably one or two and more preferably one).

In addition, this organosilicon polymer more preferably has a substructure represented by the following formula (2):

$$R—SiO_{3/2} \quad (2).$$

The R here represents a hydrocarbon group having from 1 to 10 (preferably from 1 to 6) carbons.

The average thickness Dav. of the organosilicon polymer-containing surface layer can be determined by observation of the cross section of the toner particle using a transmission electron microscope (TEM), and the details are described below.

The surface layer preferably has an average thickness Dav. of from 5.0 nm to 70.0 nm and more preferably from 10.0 nm to 50.0 nm. The mechanical strength of the toner is increased and the development durability is enhanced by having the average thickness of at least 5.0 nm. By having the average thickness of not more than 70.0 nm, the interaction of the organosilicon polymer with the wax acts to the outermost surface of the organosilicon polymer and the transferability-enhancing effect is better obtained.

This average thickness Dav. can be controlled through judicious modification of the method of toner particle production at the time of organosilicon polymer formation; the hydrolysis at the time of organosilicon polymer formation; the reaction temperature, reaction time, reaction solvent, and pH during polymerization; and the content of the organosilicon polymer.

The sol-gel method is a preferred example of organosilicon polymer production. The sol-gel method is a method that uses a liquid starting material as the point of departure and carries out hydrolysis and condensation polymerization thereon to induce gelation via a sol state. The sol-gel method is used as a method for synthesizing glasses, ceramics, organic-inorganic hybrids, and nanocomposites. This production method can be used to produce functional materials in a variety of forms, e.g., surface layers, fibers, bulk articles, and fine particles, from a liquid phase at low temperatures.

In specific terms, the organosilicon polymer present in the surface layer of the toner particle is preferably produced by the hydrolysis and condensation polymerization of an organosilicon compound as typified by alkoxysilanes.

By disposing this organosilicon polymer-containing surface layer on the toner particle, a toner can be obtained that exhibits an enhanced environmental stability and that is resistant to reductions in the properties of the toner during long-term storage and has an excellent storage stability.

The sol-gel method starts out from a liquid and forms a material by the gelation of this liquid and as a consequence can provide a variety of microstructures and shapes. When, in particular, the toner particle is produced in an aqueous medium, deposition of the organosilicon polymer on the surface layer of the toner particle is facilitated by the hydrophilicity generated by a hydrophilic group, e.g., the silanol group, in the organosilicon compound. The microstructure and shape can be adjusted through, for example, the reaction temperature, reaction time, reaction solvent, pH, and species and amount of the organometal compound.

The following are specific examples of organosilicon compounds for producing the organosilicon polymer: methyltrimethoxysilane, methyltriethoxysilane, methyltrichlorosilane, ethyltrimethoxysilane, ethyltriethoxysilane, ethyltrichlorosilane, ethyltriacetoxysilane, propyltrimethoxysilane, propyltriethoxysilane, propyltrichlorosilane, butyltrimethoxysilane, butyltriethoxysilane, butyltrichlorosilane, butylmethoxydichlorosilane, butylethoxydichlorosilane, hexyltrimethoxysilane, and hexyltriethoxysilane. A single organosilicon compound may be used by itself or two or more may be used in combination.

When a content of the wax (preferably an ester wax with the structure given in the preceding formula (3) or formula (4)) with reference to a total mass of the toner particle is taken as X mass % and a content of the organosilicon polymer that the toner particle contains in the surface layer is taken as Y mass %, a ratio of X to Y (X/Y) is preferably from 3.0 to 30.0 and is more preferably from 4.0 to 20.0. The balance among the effects on the development durability, low-temperature fixability, and transferability is enhanced when X/Y is in the indicated range.

The toner particle may contain a colorant, for example, a pigment. There are no particular limitations on this pigment, and the known pigments indicated in the following may be used.

For example, yellow iron oxide, Naples Yellow, Naphthol Yellow S, Hansa Yellow G, Hansa Yellow 10G, Benzidine Yellow G, Benzidine Yellow GR, quinoline yellow lake, condensed azo compounds such as Permanent Yellow NCG and tartrazine lake, isoindolinone compounds, anthraquinone compounds, azo metal complexes, methine compounds, and allylamide compounds may be used as a yellow pigment. The following are specific examples:

C. I. Pigment Yellow 12, C. I. Pigment Yellow 13, C. I. Pigment Yellow 14, C. I. Pigment Yellow 15, C. I. Pigment Yellow 17, C. I. Pigment Yellow 62, C. I. Pigment Yellow 74, C. I. Pigment Yellow 83, C. I. Pigment Yellow 93, C. I. Pigment Yellow 94, C. I. Pigment Yellow 95, C. I. Pigment Yellow 109, C. I. Pigment Yellow 110, C. I. Pigment Yellow 111, C. I. Pigment Yellow 128, C. I. Pigment Yellow 129, C. I. Pigment Yellow 147, C. I. Pigment Yellow 155, C. I. Pigment Yellow 168, and C. I. Pigment Yellow 180.

Orange pigments can be exemplified by the following: Permanent Orange GTR, Pyrazolone Orange, Vulcan Orange, Benzidine Orange G, Indathrene Brilliant Orange RK, and Indathrene Brilliant Orange GK.

For example, red iron oxide; condensed azo compounds such as Permanent Red 4R, Lithol Red, Pyrazolone Red, Watching Red calcium salt, Lake Red C, Lake Red D, Brilliant Carmine 6B, Brilliant Carmine 3B, eosin lake, Rhodamine Lake B, and Alizarin Lake; diketopyrrolopyrrole compounds; anthraquinone; quinacridone compounds; basic dye lake compounds; naphthol compounds; benzimidazolone compounds; thioindigo compounds; and perylene compounds are examples of red pigments. The following are specific examples:

C. I. Pigment Red 2, C. I. Pigment Red 3, C. I. Pigment Red 5, C. I. Pigment Red 6, C. I. Pigment Red 7, C. I. Pigment Red 23, C. I. Pigment Red 48:2, C. I. Pigment Red 48:3, C. I. Pigment Red 48:4, Pigment Red 57:1, C. I. Pigment Red 81:1, C. I. Pigment Red 122, C. I. Pigment Red 144, C. I. Pigment Red 146, C. I. Pigment Red 166, C. I. Pigment Red 169, C. I. Pigment Red 177, C. I. Pigment Red 184, C. I. Pigment Red 185, C. I. Pigment Red 202, C. I. Pigment Red 206, C. I. Pigment Red 220, C. I. Pigment Red 221, and C. I. Pigment Red 254.

Blue pigments can be exemplified by alkali blue lake; Victoria Blue Lake; copper phthalocyanine compounds and derivatives thereof, e.g., Phthalocyanine Blue, metal-free Phthalocyanine Blue, partially chlorinated Phthalocyanine Blue, Fast Sky Blue, and Indathrene BG; anthraquinone compounds; and basic dye lake compounds. Specific examples are as follows:

C. I. Pigment Blue 1, C. I. Pigment Blue 7, C. I. Pigment Blue 15, C. I. Pigment Blue 15:1, C. I. Pigment Blue 15:2, C. I. Pigment Blue 15:3, C. I. Pigment Blue 15:4, C. I. Pigment Blue 60, C. I. Pigment Blue 62, and C. I. Pigment Blue 66.

Purple pigments can be exemplified by Fast Violet B and Methyl Violet Lake.

Green pigments can be exemplified by Pigment Green B, Malachite Green Lake, and Final Yellow Green G.

White pigments can be exemplified by zinc white, titanium oxide, antimony white, and zinc sulfide.

Black pigments can be exemplified by carbon black, aniline black, nonmagnetic ferrite and magnetite, and black pigments provided by color mixing using the aforementioned yellow pigments, red pigments, and blue pigments to give a black color.

A single one of these pigments may be used by itself or a mixture of two or more may be used. In addition, the pigments may also be used in the form of a solid solution.

The pigment content, per 100 mass parts of the binder resin or polymerizable monomer, is preferably from 3.0 mass parts to 10.0 mass parts.

The toner particle may contain, in a range that does not have an effect on the effects of the present invention, a resin other than the binder resin. The following resins, for example, can be used as the resin other than the binder resin:

homopolymers of styrene or a derivative thereof, e.g., polystyrene and polyvinyltoluene; styrene copolymers such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleate ester copolymer; as well as polymethyl methacrylate, polybutyl methacrylate, polyvinyl acetate, polyethylene, polypropylene, polyvinyl butyral, silicone resins, polyester resins, polyamide resins, epoxy resins, polyacrylic resins, rosin, modified rosin, terpene resins, phenolic resins, aliphatic hydrocarbon resins, alicyclic hydrocarbon resins, and aromatic petroleum resins.

A single one of these may be used by itself or a mixture of two or more may be used.

The toner particle may contain, in a range that does not have an effect on the effects of the present invention, a charge control agent.

Charge control agents that control the toner to negative charging can be exemplified by metal compounds of aromatic carboxylic acids such as salicylic acid, alkylsalicylic acid, dialkylsalicylic acid, naphthoic acid, and dicarboxylic acids; metal salts and metal complexes of azo dyes and azo pigments; boron compounds; silicon compounds; and calixarene. Charge control agents that control the toner to positive charging can be exemplified by quaternary ammonium salts and polymer compounds that have a quaternary ammonium salt in side chain position; guanidine compounds; nigrosine compounds; and imidazole compounds.

A single one of these may be used by itself or a mixture of two or more may be used.

With the goal of improving the flowability, the toner particle may contain a flowability improver in a range that does not have an effect on the effects of the present invention. The type of flowability improver can be exemplified by fluororesin powders, e.g., vinylidene fluoride fine powders and polytetrafluoroethylene fine powders; metal salts of fatty acids, e.g., zinc stearate, calcium stearate, and zinc stearate; metal oxides, e.g., titanium oxide powder, aluminum oxide powder, and zinc oxide powder, as well as powders provided by subjecting these metal oxides to a hydrophobic treatment; and silica fine powders such as silica produced by a wet method and silica produced by a dry method, as well as surface-treated silica fine powders provided by subjecting these silicas to a surface treatment with a treatment agent such as a silane coupling agent, titanium coupling agent, silicone oil, and so forth.

A single one of these may be used by itself or a mixture of two or more may be used.

The toner particle may contain a polar resin in a range that does not have an effect on the effects of the present invention. For example, a styrene copolymer, e.g., a styrene-2-hydroxyethyl methacrylate-methacrylic acid-methyl methacrylate copolymer, may be used as the polar resin. A single one of these may be used by itself or a mixture of two or more may be used.

The toner particle may be used as such as a toner, or as necessary may be made into a toner by mixing with, e.g., an external additive, in order to attach same to the toner particle surface. For example, inorganic fine particles, e.g., silica fine particles, titanium oxide fine particles, and aluminum oxide fine particles, are advantageously used for the external additive. These inorganic fine particles have preferably been subjected to a hydrophobic treatment using a hydrophobic agent, e.g., a silane coupling agent, silicone oil, or mixture thereof.

The external additive is preferably used at from 0.1 mass parts to 10.0 mass parts per 100 mass parts of the toner particle. A known mixer, e.g., a HENSCHEL MIXER, may be used to mix the toner particle with the external additive.

Methods for producing the toner particle and toner are described in the following.

A known means can be used for the method of producing the toner particle; for example, a kneading pulverization method or a wet production method may be used. A wet production method is preferred therebetween from the standpoint of shape controllability and achieving a more uniform particle diameter. The wet production method can be specifically exemplified by the suspension polymerization method, dissolution suspension method, emulsion polymerization aggregation method, and emulsion aggregation method.

The suspension polymerization method is described here; however, the method for producing the toner particle and toner by suspension polymerization is not limited to the procedure described in the following.

The suspension polymerization method commences with the preparation of a polymerizable monomer composition by dissolving or dispersing the wax and polymerizable monomer for binder resin production to uniformity using a disperser such as a ball mill or ultrasound disperser (polymerizable monomer composition preparation step). At this point, for example, a colorant, multifunctional monomer, chain transfer agent, charge control agent, plasticizer, and so forth can optionally be added as appropriate.

The following vinyl polymerizable monomers are advantageous examples of the polymerizable monomer in the suspension polymerization method:

styrene; styrene derivatives, e.g., α-methylstyrene, β-methylstyrene, o-methylstyrene, m-methylstyrene, p-methylstyrene, 2,4-dimethyl styrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers, e.g., methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; methacrylic polymerizable monomers, e.g., methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; esters of methylene aliphatic monocarboxylic acids; vinyl esters, e.g., vinyl acetate, vinyl propionate, vinyl benzoate, vinyl butyrate, and vinyl formate; vinyl ethers such as vinyl methyl ether, vinyl ethyl ether, and vinyl isobutyl ether; as well as vinyl methyl ketone, vinyl hexyl ketone, and vinyl isopropyl ketone.

A single one of these may be used by itself or a mixture of two or more may be used.

The polymerizable monomer composition is then introduced into a previously prepared aqueous medium and droplets of the polymerizable monomer composition are formed in the desired toner particle size using, for example, a high-shear stirrer or a disperser (granulation step).

The aqueous medium in the granulation step preferably contains a dispersion stabilizer in order to suppress toner particle coalescence during the production sequence, control the particle size of the toner particle, and sharpen the particle size distribution. The dispersion stabilizers can be generally categorized into polymers, which generate a repulsive force through steric hindrance, and sparingly water-soluble inorganic compounds, which support dispersion stabilization through an electrostatic repulsive force. Fine particles of a sparingly water-soluble inorganic compound, because they can be dissolved by acid or alkali, are advantageously used because they can be easily removed by dissolution by washing with acid or alkali after polymerization.

The use is preferred of a sparingly water-soluble inorganic compound that contains at least one selection from the group consisting of magnesium, calcium, barium, zinc, aluminum, and phosphorus. A sparingly water-soluble inorganic compound that contains any of at least one selection from the group consisting of magnesium, calcium, aluminum, and phosphorus is more preferred. Specific examples are as follows:

sodium phosphate, calcium chloride, magnesium phosphate, tricalcium phosphate, aluminum phosphate, zinc phosphate, magnesium carbonate, calcium carbonate, magnesium hydroxide, calcium hydroxide, aluminum hydroxide, calcium metasilicate, calcium sulfate, barium sulfate, and hydroxyapatite.

A single one of these may be used by itself or a mixture of two or more may be used.

The dispersion stabilizer is preferably used at from 0.01 mass parts to 2.00 mass parts per 100 mass parts of the polymerizable monomer.

An organic compound, for example, polyvinyl alcohol, gelatin, methyl cellulose, methyl hydroxypropyl cellulose, ethyl cellulose, the sodium salt of carboxymethyl cellulose, and starch, may also be used in combination in the aforementioned dispersion stabilizer.

A surfactant may also be used in combination at from 0.001 mass parts to 0.1 mass parts per 100 mass parts of the polymerizable monomer in order to microfine-size these dispersion stabilizers. Specifically, a commercial nonionic, anionic, or cationic surfactant can be used. For example, the use is preferred of sodium dodecyl sulfate, sodium tetradecyl sulfate, sodium pentadecyl sulfate, sodium octyl sulfate, sodium oleate, sodium laurate, potassium stearate, or calcium oleate.

The polymerizable monomer present in the polymerizable monomer composition is polymerized, after the granulation step or while carrying out the granulation step, to obtain a toner particle dispersion (polymerization step). The temperature during polymerization is preferably from 50° C. to 90° C.

A stirring process is preferably carried out during the polymerization step so as to provide a uniform temperature distribution in the vessel.

A polymerization initiator can be added to the reaction system in the polymerization step. When a polymerization initiator is added, this addition may be carried out using any timing and for any required length of time. In addition, with the goal of obtaining a desired molecular weight distribution, the temperature may be raised in the latter half of the polymerization reaction, and, in order to remove, e.g., unreacted polymerizable monomer and by-products, from the system, a portion of the aqueous medium may be distilled off by a distillation process in the latter half of the reaction or after the completion of the reaction. The distillation process is carried out at normal pressure or under reduced pressure.

An oil-soluble initiator is generally used as the polymerization initiator used in the suspension polymerization method. The following are examples:

azo compounds, e.g., 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile, and peroxide initiators such as acetyl cyclohexylsulfonyl peroxide, diisopropyl peroxycarbonate, decanoyl peroxide, lauroyl peroxide, stearoyl peroxide, propionyl peroxide, acetyl peroxide, tert-butyl peroxy-2-ethylhexanoate, benzoyl peroxide, tert-butyl peroxyisobutyrate, cyclohexanone peroxide, methyl ethyl ketone peroxide, dicumyl peroxide, tert-butyl hydroperoxide, di-tert-butyl peroxide, tert-butyl peroxypivalate, and cumene hydroperoxide.

A single one of these may be used by itself or a mixture of two or more may be used.

A combination with a water-soluble initiator may as necessary also be used for the polymerization initiator. The water-soluble initiator can be exemplified by the following:

ammonium persulfate, potassium persulfate, 2,2'-azobis(N,N'-dimethyleneisobutyroamidine) hydrochloride, 2,2'-azobis(2-aminodinopropane) hydrochloride, azobis(isobutylamidine) hydrochloride, sodium 2,2'-azobisisobutyronitrilesulfonate, ferrous sulfate, and hydrogen peroxide.

A single one of these polymerization initiators may be used by itself or two or more may be used in combination. A chain transfer agent, polymerization inhibitor, and so forth may also be added and used in order to control the degree of polymerization of the polymerizable monomer.

The particle diameter of the toner particle is preferably a weight-average particle diameter of 3.0 μm to 10.0 μm from the standpoint of obtaining a high-definition and high-resolution image. The weight-average particle diameter of the toner can be measured using the pore electrical resistance method. Measurement can be performed, for example, using a "Coulter Counter Multisizer 3" (Beckman Coulter, Inc.).

The thusly obtained toner particle dispersion is transferred to a filtration step that performs solid-liquid separation of the toner particle from the aqueous medium.

The solid-liquid separation for recovering the toner particle from the obtained toner particle dispersion can be carried out using ordinary filtration methods. This is preferably followed by further washing by, e.g., reslurrying or wash through with wash water, in order to remove foreign material that has resisted removal from the toner particle surface. After thorough washing has been carried out, solid-liquid separation is performed again to obtain a toner cake. The toner particle is obtained by then drying by a known drying means and as necessary performing classification to separate particle groups having a particle diameter outside the prescribed particle diameter. The separated particle groups having a noncompliant particle diameter at this point may be reused in order to improve the ultimate yield.

In the case of formation of an organosilicon polymer-containing surface layer, when the toner particle is formed in an aqueous medium this surface layer can be formed by adding a hydrolyzate solution of the organosilicon compound, supra, while carrying out, for example, the polymerization step in the aqueous medium. A hydrolyzate solution of the organosilicon compound may be added and the indicated surface layer may be formed using the post-polymerization toner particle dispersion as a core particle dispersion. In addition, a toner particle obtained in other than an aqueous medium, such as by the kneading pulverization method, may be dispersed in an aqueous medium and this may be used as a core particle dispersion and a hydrolyzate solution of the organosilicon compound, supra, may be added and the indicated surface layer may be formed.

The following method is particularly preferred.

First, a core particle for a toner containing binder resin and colorant is produced and is dispersed in an aqueous medium to obtain a core particle dispersion. With regard to the concentration at this point, preferably the core particle is dispersed at a concentration that provides a core particle solids fraction of from 10 mass % to 40 mass % with reference to the total amount of the core particle dispersion. In addition, the temperature of the core particle dispersion is preferably adjusted to at least 35° C. before further processing.

The pH of the core particle dispersion is preferably adjusted to a pH that inhibits the development of condensation of the organosilicon compound. The pH at which organosilicon compound condensation is inhibited varies with the particular material and as a consequence is preferably within ±0.5 centered on the pH at which the reaction is most inhibited.

The use is preferred of an organosilicon compound that has been subjected to a hydrolysis treatment. For example, hydrolysis may be carried out in advance in a separate vessel as a pretreatment for the organosilicon compound. The charge concentration for hydrolysis, using 100 mass parts for the amount of the organosilicon compound, is preferably from 40 mass parts to 500 mass parts and more preferably from 100 mass parts to 400 mass parts of water from which the ionic fraction has been removed, for example, deionized water or RO water. The conditions during hydrolysis are preferably a pH of 2 to 7, a temperature of 15° C. to 80° C., and a time of 30 minutes to 600 minutes.

By mixing the obtained hydrolysis solution and the core particle dispersion and adjusting to a pH suitable for condensation (preferably from 1 to 3 or from 6 to 12 and more preferably from 8 to 12), a surface layer can be attached to the core particle surface of the toner while causing condensation of the organosilicon compound. Condensation and surface layer attachment are preferably carried out for at least 60 minutes at least 35° C.

A time interval of holding at least 35° C. may be provided prior to adjusting to the pH suitable for condensation. This time interval is preferably from 3 minutes to 120 minutes viewed from the standpoints of adjusting the macrostructure of the toner particle surface layer and facilitating obtaining a toner having a preferred Martens hardness.

The measurement methods pertinent to the toner particle and toner are each described in detail in the following.

<Method for Measuring Percentage Deformation of Toner Particle and Rate of Increase in Percentage Deformation>

Calculation from the load-versus-percentage deformation curve provided by an indentation test can be used as the method for measuring the percentage deformation of the toner particle and the rate of increase in the percentage deformation. Specifically, an "NS-A100" (Nano Seeds Corporation) instrument for measuring the crushing strength of fine particles is used. The specific method for measuring the load-versus-percentage deformation curve is as follows.

For the measurement environment, the test stand is held at 25.0° C. or 45.0° C. using an accessory temperature-conditioning apparatus. The toner is coated on the test stand followed by setting to the indicated temperature and holding for at least 10 minutes and then carrying out the measurement.

The measurement is carried out using as the indenter a flat indenter of 0.014 mN/Lm that is an accessory for the instrument. A flat indenter is used with a small-diameter spherical object such as toner, or an object to which an external additive is attached, or an object having surface unevenness, due to the large influence on measurement accuracy when a pointed indenter is used. The procedure is run with the amount of indention in the test set to 60 μm and the displacement velocity of the indenter set to 0.2 μm/s. By using these test loading settings, the measurement can be carried out into the region in which the toner particle undergoes plastic deformation and the measurement can be run under conditions approximating the stresses in the development step and fixing step. The number of indentation data points is set to 3001.

For the particles to be measured, independently occurring toner particles are selected on the measurement screen using the microscope attached to the instrument. In order to minimize error in the amount of displacement, particles are selected that have a particle diameter (D) in the range of the number-average particle diameter (D1)±0.5 μm (D1−0.5 μm≤D≤D1+0.5 μm). Using the software provided with the instrument, the long diameter and short diameter of the toner are measured and the particle diameter D (m) of the particle to be measured is taken to be [(long diameter+short diameter)/2]. The number-average particle diameter is measured by the method described below using a "Coulter Counter Multisizer 3" (Beckman Coulter, Inc.).

The measurement is carried out by randomly selecting 100 particles of toner for which the particle diameter D (m) satisfies the aforementioned condition.

Analysis is carried out using the "A100 strain analysis graph construction tool" provided with the "NS-A100" instrument for measuring the crushing strength of fine particles. When the "graph construction" menu is selected and measurement data is selected, the load and amount of deformation are output as the analysis data. The percentage deformation can be derived by dividing the obtained amount of deformation by the number-average particle diameter (D1) and a load-versus-percentage deformation curve can be obtained. In the obtained load-versus-percentage deformation curve, the rate of increase in the percentage deformation of the toner particle is obtained by carrying out a linear approximation, with the load being taken as a variable, on all the measurement points from the minimum value to the maximum value of the percentage deformation in the range where the percentage deformation satisfies from 15% to 30%.

This measurement and analysis are performed on 100 particles of toner, and the resulting arithmetic average value is taken to be the rate of increase A or B in the percentage deformation of the toner particle referenced by the present invention.

<Method for Measuring Martens Hardness of Toner Particle>

The Martens hardness of the toner particle can be derived from the load-versus-displacement curve obtained in accordance with the indentation test procedure specified in ISO 14577-1 using a commercial instrument that conforms to ISO 14577-1. An "ENT-1100b" (Elionix Inc.) nanoindentation hardness tester is used in the present invention as the instrument conforming to the aforementioned ISO standard. The measurement method is described in the "ENT 1100 Operating Manual" provided with the instrument, and the specific measurement method is as follows.

For the measurement environment, the interior of the sealed case is maintained at 30.0° C. using the accessory temperature control device. Maintenance of a constant atmospheric temperature is effective for reducing the scatter in the measurement data due to, for example, thermal expansion and drift. A condition of 30.0° C. is used for the set temperature because this is hypothesized to be the temperature in the vicinity of the developing device where the toner is subjected to friction. The standard test stand provided with the instrument is used as the test stand and, after coating with the toner, the toner is dispersed using a very weak air current. The test stand is then set in the instrument and is allowed to stand for at least one hour, after which the measurement is performed.

The measurement is run using as the indenter a flat indenter (titanium indenter, diamond tip) provided with the instrument; the tip is a 20 μm×20 μm flat surface. A flat indenter is used with a small-diameter spherical object such as toner, or an object to which an external additive is attached, or an object having surface unevenness, due to the large influence on measurement accuracy when a pointed indenter is used. The maximum load in the test is set to $2.0\times10^{-4}$ N. The use of this test load setting makes it possible to measure the hardness under conditions corresponding to the stress received by one particle of toner in the developing section and to do so without rupturing the toner surface layer.

For the particles to be measured, independently occurring toner particles are selected on the measurement screen (size of visual field: 160 μm horizontal, 120 μm vertical) using the microscope attached to the instrument. In order to minimize error in the amount of displacement, particles are selected that have a particle diameter (D) in the range of the number-average particle diameter (D1)±0.5 μm (D1−0.5 μm≤D≤D1+0.5 μm). To measure the particle diameter of the particle to be measured, the long diameter and short diameter of the toner are measured using the software provided with the instrument and the particle diameter D (m) is taken to be [(long diameter+short diameter)/2]. The number-average particle diameter is measured by the method described below using a "Coulter Counter Multisizer 3" (Beckman Coulter, Inc.).

The measurement is carried out by randomly selecting 100 particles of toner for which the particle diameter D (m) satisfies the aforementioned condition. The following conditions are input when the measurement is carried out.

test mode: load/unload test
test load: 20,000 mgf (=$2.0\times10^{-4}$ N)
number of divisions: 1000 steps
step interval: 10 msec When the measurement is run after selecting "Data Analysis (ISO)" on the analysis menu, after measurement the Martens hardness is analyzed and output by the software provided with the instrument. This measurement is carried out on 100 particles of toner, and the arithmetic average thereof is used as the Martens hardness in the present invention.

<Compositional Analysis of Wax Structure>

The compositional analysis of the wax in the toner particle can be carried out using nuclear magnetic resonance ($^{1}$H-NMR, $^{13}$C-NMR) and FT-IR spectroscopy. The instruments used are described below.

Each sample may be acquired by sampling from the toner and submitted to analysis.

(i)$^{1}$H-NMR, $^{13}$C-NMR
measurement instrument: JNM-EX400 FT-NMR instrument (JEOL Ltd.)
measurement frequency: 400 MHz
pulse condition: 5.0 μs
frequency range: 10,500 Hz
number of scans: 64
(ii) FT-IR Spectroscopy
AVATAR 360 FT-IR from Thermo Fisher Scientific Inc.

<Method for Confirming Substructure Given by Formula (2)>

The following method is used to confirm the substructure represented by formula (2) in the organosilicon polymer contained in the toner particle.

The hydrocarbon group represented by R in formula (2) is confirmed by 13C-NMR.

(Measurement Conditions in $^{13}$C-NMR (Solid State))
instrument: JNM-ECX500II, JEOL RESONANCE
sample tube: 3.2 mmϕ
sample: tetrahydrofuran-insoluble matter of the toner particle for NMR
measurement, 150 mg
measurement temperature: room temperature
pulse mode: CP/MAS
measurement nucleus frequency: 123.25 MHz ($^{13}$C)
reference substance: adamantane (external reference: 29.5 ppm)
sample spinning rate: 20 kHz
contact time: 2 ms
delay time: 2 s
number of scans: 1024

The hydrocarbon group represented by R in formula (2) is confirmed by this method through the presence/absence of a signal originating with, for example, a silicon atom-bonded methyl group (Si—$CH_3$), ethyl group (Si—$C_2H_5$), propyl group (Si—$C_3H_7$), butyl group (Si—$C_4H_9$), pentyl group (Si—$C_5H_{11}$), hexyl group (Si—$C_6H_{13}$), or phenyl group (Si—$C_6H_5$).

<Method for Calculating Percentage of Peak Area Assigned to Formula (2) Structure for Organosilicon Polymer Contained in Toner Particle>

$^{29}$Si-NMR (solid state) measurement on the THF-insoluble matter in the toner particle is carried out using the following measurement conditions.

(Measurement Conditions in $^{29}$Si-NMR (Solid State))
instrument: JNM-ECX500II, JEOL RESONANCE
sample tube: 3.2 mmϕ
sample: tetrahydrofuran-insoluble matter of the toner particle for NMR
measurement, 150 mg
measurement temperature: room temperature
pulse mode: CP/MAS
measurement nucleus frequency: 97.38 MHz ($^{29}$Si)
reference substance: DSS (external reference: 1.534 ppm)
sample spinning rate: 10 kHz
contact time: 10 ms
delay time: 2 s
number of scans: 2,000 to 8,000

After this measurement, peak separation is performed, for the tetrahydrofuran-insoluble matter of the toner particle, into the following structure Q1, structure Q2, structure Q3, and structure Q4 by curve fitting for silane components having different substituents and bonding groups, and their respective peak areas are calculated.

structure Q1: $(Ri)(Rj)(Rk)SiO_{1/2}$ formula (5)

structure Q2: $(Rg)(Rh)Si(O_{1/2})_2$ formula (6)

structure Q3: $RmSi(O_{1/2})_3$ formula (7)

structure Q4: $Si(O_{1/2})_4$ formula (8)

structure Q1:

(5)

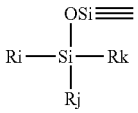

structure Q2:

(6)

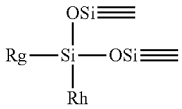

structure Q3:

(7)

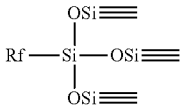

structure Q4:

(8)

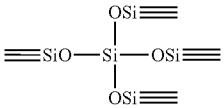

The Ri, Rj, Rk, Rg, Rh, and Rm in formulas (5), (6), and (7) represent a silicon atom-bonded organic group, e.g., a hydrocarbon group having from 1 to 6 carbons, halogen atom, hydroxy group, acetoxy group, or alkoxy group.

When a more discriminating determination of the substructure represented by formula (2) is required, identification can be carried out using the measurement results from $^{1}$H-NMR in combination with these measurement results from $^{13}$C-NMR and $^{29}$Si-NMR.

<Method for Measuring Weight-Average Particle Diameter (D4) and Number-Average Particle Diameter (D1) of Toner Particle>

A precision particle size distribution measurement instrument operating on the pore electrical resistance method (trade name: Coulter Counter Multisizer 3) and the dedicated software (trade name: Beckman Coulter Multisizer 3 Version 3.51, Beckman Coulter, Inc.) are used. An aperture tube having diameter of 100 μm are also used, and the measurement in 25,000 channels for the number of effective measurement channels is performed, thereby analyzing and calculating the measurement data. As the aqueous electrolyte solution used for the measurements, "ISOTON II" (Beckman Coulter, Inc.), which is prepared by dissolving special-grade sodium chloride in deionized water to provide a concentration of approximately 1 mass % can be exemplified. The dedicated software is configured as follows prior to measurement and analysis.

In the "modify the standard operating method (SOM)" screen in the dedicated software, the total count number in the control mode is set to 50,000 particles; the number of measurements is set to one time; and the Kd value is set to the value obtained using "standard particle 10.0 μm" (Beckman Coulter, Inc.). The threshold value and noise level are automatically set by pressing the threshold value/noise level measurement button. In addition, the current is set to 1600 μA; the gain is set to 2; the electrolyte is set to ISOTON II (trade name); and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to at least 2 μm and not more than 60 μm.

The specific measurement procedure is as follows.

(1) Approximately 200 mL of the above-described aqueous electrolyte solution is introduced into a 250-mL round-bottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the above-described aqueous electrolyte solution is introduced into a 100-mL flat-bottom glass beaker. To this is added approximately 0.3 mL of a dilution prepared by the three-fold (mass) dilution with deionized water of "Contaminon N" (trade name) (a 10 mass % aqueous solution of a neutral detergent for cleaning precision measurement instrumentation, Wako Pure Chemical Industries, Ltd.).

(3) A prescribed amount of deionized water is introduced into the water tank of an ultrasonic disperser (trade name: Ultrasonic Dispersion System Tetora 150, Nikkaki Bios Co., Ltd.), which is an with an electrical output of 120 W and equipped with two oscillators (oscillation frequency=50 kHz) disposed such that the phases are displaced by 180°, and approximately 2 mL of Contaminon N (trade name) is added to this water tank.

(4) The beaker described in above (2) is set into the beaker holder opening on the ultrasonic disperser and the ultrasonic disperser is started. The vertical position of the beaker is adjusted in such a manner that the resonance condition of the surface of the aqueous electrolyte solution within the beaker is at a maximum.

(5) While the aqueous electrolyte solution within the beaker set up according to above (4) is being irradiated with ultrasonic, approximately 10 mg of the toner (particle) is added to the aqueous electrolyte solution in small aliquots and dispersion is carried out. The ultrasonic dispersion treatment is continued for an additional 60 seconds. The water temperature in the water tank is controlled as appropriate during ultrasonic dispersion to be from 10° C. to 40° C.

(6) Using a pipette, the dispersed toner (particle)-containing aqueous electrolyte solution prepared in above (5) is dropped into the round-bottom beaker set in the sample stand as described in above (1) with adjustment to provide a measurement concentration of approximately 5%. Measurement is then performed until the number of measured particles reaches 50,000.

(7) The weight-average particle diameter (D4) and the number-average particle diameter (D1) are calculated by analyzing the measurement data using the previously cited dedicated software provided with the instrument. When set to graph/volume % with the dedicated software, the "average diameter" on the analysis/volumetric statistical value (arithmetic average) screen is the weight-average particle diameter (D4), and when set to graph/number % with the dedicated software, the "average diameter" on the "analysis/numerical statistical value (arithmetic average)" screen is the number-average particle diameter (D1).

<Method for Measuring Content of Wax in Toner Particle>

The content of the wax in the toner particle is measured using a "Q1000" differential scanning calorimeter (TA Instruments). Temperature correction in the instrument detection section is performed using the melting points of indium and zinc, and the amount of heat is corrected using the heat of fusion of indium.

Specifically, the endothermic quantity for the wax itself is measured first.

1 mg of the wax used in the toner (when a plurality is used, wax mixed at the ratio used in the toner) is exactly weighed and this is introduced into an aluminum pan. An empty aluminum pan is used for reference. Heating is carried out from 0° C. to 150° C. at a ramp rate of 10° C./minute and holding is performed for 5 minutes at 150° C. This is followed by cooling from 150° C. to 0° C. at a cooling rate of 10° C./minute. After holding for 5 minutes at 0° C., the temperature is raised from 0° C. to 150° C. at a ramp rate of 10° C./minute. The endothermic quantity ΔH1 (J/g) for the endothermic peak in this DSC curve is designated as the endothermic quantity for the wax itself.

The endothermic quantity for the toner is then measured. 1 mg of the toner is exactly weighed out and this is introduced into an aluminum pan; an empty aluminum pan is used for reference. The temperature is raised from 0° C. to 150° C. at a ramp rate of 10° C./minute, and the endothermic quantity ΔH2 (J/g) for the endothermic peak in this DSC curve is designated as the endothermic quantity for the toner.

The content of the wax in the toner particle was measured in accordance with the following formula using the endothermic quantity for the wax itself and the endothermic quantity for the toner that were measured by the procedure described above.

$$\text{content (mass \%) of wax in the toner particle} = \Delta H2/\Delta H1 \times 100$$

<Method for Measuring Content of Organosilicon Polymer in Toner Particle>

An "Axios" wavelength-dispersive x-ray fluorescence analyzer (PANalytical B.V.) is used to measure the organosilicon polymer content, and the "SuperQ ver. 4.0F" (PANalytical B.V.) software provided with the instrument is used in order to set the measurement conditions and analyze the measurement data. Rhodium is used for the x-ray tube anode; a vacuum is used for the measurement atmosphere; the measurement diameter (collimator mask diameter) is 27 mm; and the measurement time is 10 seconds. Detection is carried out with a proportional counter (PC) in the case of measurement of the light elements, and with a scintillation counter (SC) in the case of measurement of the heavy elements.

4 g of the toner particle is introduced into a specialized aluminum compaction ring and is smoothed over, and, using a "BRE-32" tablet compression molder (Maekawa Testing Machine Mfg. Co., Ltd.), a pellet is produced by molding to a thickness of 2 mm and a diameter of 39 mm by compression for 60 seconds at 20 MPa, and this pellet is used as the measurement sample.

0.5 mass parts of silica ($SiO_2$) fine powder is added to 100 mass parts of the toner particle not containing organosilicon polymer and thorough mixing is performed using a coffee mill. 5.0 mass parts and 10.0 mass parts of the silica fine powder are each likewise mixed with the toner particle, and these are used as samples for calibration curve construction.

For each of these samples, a pellet of the sample for calibration curve construction is fabricated proceeding as above using the tablet compression molder, and the count rate (unit: cps) is measured for the Si—Kα radiation observed at a diffraction angle (2θ)=109.08° using PET for the analyzer crystal. In this case, the acceleration voltage and current value for the x-ray generator are, respectively, 24 kV and 100 mA. A calibration curve in the form of a linear function is obtained by placing the obtained x-ray count rate on the vertical axis and the amount of $SiO_2$ addition to each calibration curve sample on the horizontal axis.

The toner particle to be analyzed is then made into a pellet proceeding as above using the tablet compression molder and is subjected to measurement of its Si—Kα radiation count rate. The content of the organosilicon polymer in the toner particle is determined from the aforementioned calibration curve.

<Method for Measuring Average Thickness Dav. Of Surface Layer of Toner Particle, by Observation of Toner Particle Cross Section Using Transmission Electron Microscope (TEM)>

Observation of the toner particle cross section is performed for the present invention using the following method.

In the specific method for observing the toner particle cross section, the toner particles are thoroughly dispersed in a normal temperature-curable epoxy resin and curing is then carried out for 2 days in a 40° C. atmosphere. Thin samples are sliced from the resulting cured material using a microtome equipped with diamond blade. The toner particle cross section is observed by enlarging the sample to 10,000× to 100,000× using a transmission electron microscope (TEM) (JEM-2800, JEOL).

Confirmation can be performed utilizing the difference in the atomic weights between the binder resin and surface layer material and utilizing the fact that a clear contrast occurs for large atomic weights. Ruthenium tetroxide staining and osmium tetroxide staining are used to provide contrast between the materials.

The circle-equivalent diameter Dtem is determined for the toner particle cross section obtained from the TEM micrograph, and the particles used for the measurement are those particles for which this value falls within the window of ±10% of the weight-average toner particle diameter D4 as determined by the method described above.

Using the JEM-2800 from JEOL as indicated above, the dark field image of the toner particle cross section is acquired at an acceleration voltage of 200 kV. Then, using a GIF Quantum EELS detector from Gatan, Inc., the mapping image is acquired by the three window method and the surface layer is identified.

Figure 2:
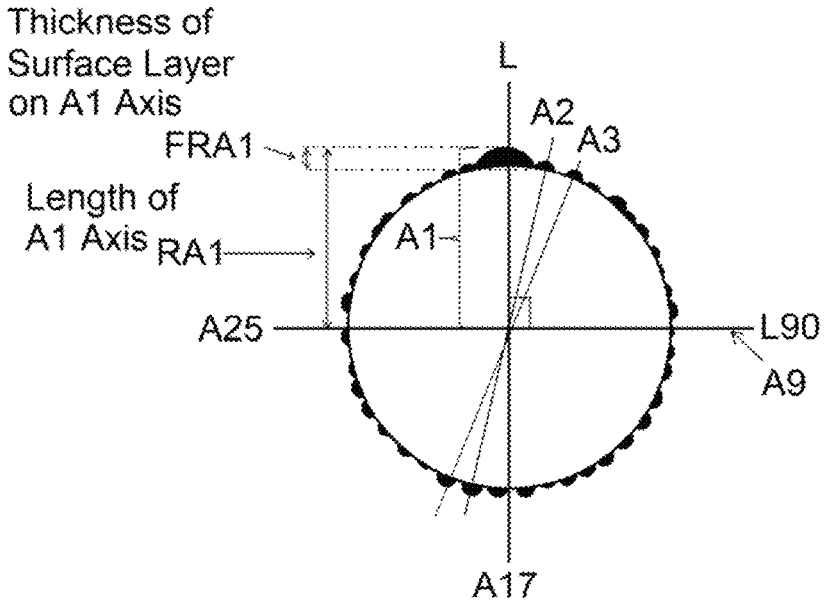
FIG. 2 is a schematic diagram that defines the average thickness of an organosilicon compound-containing surface layer.

On the individual toner particle having a circle-equivalent diameter Dtem within the window of ±10% of the weight-average toner particle diameter D4, the toner particle cross section is evenly divided into sixteenths (refer to FIG. 2) using, as the center, the intersection between the long axis L of the toner particle cross section and the axis L90 that is perpendicular to the long axis L and running through its center. Each of the dividing axes that run from this center to the toner particle surface layer is labeled An (n=1 to 32); RAn is used for the length of the dividing axis; and FRAn is used for the thickness of the surface layer.

The average thickness Day. of the organosilicon polymer-containing surface layer of the toner particle is determined for the 32 locations on the line segments (dividing axes). For averaging, the measurements are carried out on 10 toner particles and the average value per one toner particle is calculated.

[Circle-Equivalent Diameter (Dtem) Determined from Toner Particle Cross Section Obtained from Transmission Electron Microscope (TEM) Photograph]

The following method is used to determine the circle-equivalent diameter (Dtem) determined from the toner particle cross section obtained from the TEM photograph. The circle-equivalent diameter Dtem determined from the toner particle cross section obtained from the TEM photograph is first determined for a single toner particle using the following formula.

$$[\text{circle-equivalent diameter } (D\text{tem}) \text{ determined from the toner particle cross section obtained from the TEM photograph}]=(RA1+RA2+RA3+RA4+RA5+RA6+RA7+RA8+RA9+RA10+RA11+RA12+RA13+RA14+RA15+RA16+RA17+RA18+RA19+RA20+RA21+RA22+RA23+RA24+RA25+RA26+RA27+RA28+RA29+RA30+RA31+RA32)/16$$

The circle-equivalent diameter is determined for 10 toner particles, and the average value per one particle is calculated and used as the circle-equivalent diameter (Dtem) determined from the toner particle cross section.

[Measurement of Average Thickness (Dav.) of Surface Layer of Toner Particle]

The average thickness (Dav.) of the surface layer of the toner particle is determined using the following method.

First, the average thickness D(n) of the surface layer of one toner particle is determined using the following method.

$$D(n)=(\text{sum of the thickness of the surface layer on the dividing axis at the 32 locations})/32$$

For averaging, the average thickness D(n) of the toner particle surface layer is determined for 10 toner particles (n=1 to 10), and the average value per one toner particle is calculated and used as the average thickness (Dav.) of the toner particle surface layer.

$$D\text{av.}=\{D(1)+D(2)+D(3)+D(4)+D(5)+D(6)+D(7)+D(8)+D(9)+D(10)\}/10$$

EXAMPLES

The present invention is described below in greater detail using a specific production method, examples, and comparative examples, but these in no way limit the present invention. Unless specifically indicated otherwise, the number of parts in the following mixtures are on a mass basis in all instances.

Example 1

(Aqueous Medium 1 Preparation Step)

7.0 parts of sodium phosphate (dodecahydrate, RASA Industries, Ltd.) was introduced into 500.0 parts of deionized water in a reactor, and this was held for 1.0 hour at 65° C. while purging with nitrogen.

An aqueous calcium chloride solution of 4.6 parts of calcium chloride (dihydrate) dissolved in 5.0 parts of deionized water was introduced all at once while stirring at 12,000 rpm using a T. K. Homomixer (Tokushu Kika Kogyo Co., Ltd.) to prepare an aqueous medium containing a dispersion stabilizer. 10 mass % hydrochloric acid was introduced into the aqueous medium to adjust the pH to 5.0, thus yielding aqueous medium 1.

(Step of Hydrolyzing Organosilicon Compound for Surface Layer)

60.0 parts of deionized water was metered into a reactor fitted with a stirrer and thermometer and the pH was adjusted to 3.0 using 10 mass % hydrochloric acid. This was heated while being stirred to bring the temperature to 70° C. 40.0 parts of methyltriethoxysilane, the organosilicon compound for the surface layer, was then added and a hydrolysis was carried out for at least 2 hours while stirring. The end point of the hydrolysis was confirmed by visual observation when oil/water separation was not occurring and one layer had been assumed; cooling the hydrolyzate then yielded a hydrolysis solution of the organosilicon compound for the surface layer.

(Step of Preparing Polymerizable Monomer Composition)

| | |
|---|---|
| styrene | 60.0 parts |
| C.I. Pigment Blue 15:3 | 6.5 parts |

These materials were introduced into an attritor (Mitsui Miike Chemical Engineering Machinery Co., Ltd.) and dispersion was carried out for 5.0 hours at 220 rpm using zirconia particles with a diameter of 1.7 mm to prepare a pigment dispersion. The following materials were added to this pigment dispersion.

| | |
|---|---|
| styrene | 20.0 parts |
| n-butyl acrylate | 20.0 parts |
| crosslinker (divinylbenzene) | 0.3 parts |
| wax (ethylene glycol distearate) | 15.0 parts |
| polar resin | 5.0 parts |

(styrene-2-hydroxyethyl methacrylate-methacrylic acid-methyl methacrylate copolymer, acid value=10 mg KOH/g, Tg=80° C., Mw=15,000)

This was held at 65° C. and a polymerizable monomer composition was prepared by dissolving and dispersing to uniformity at 500 rpm using a T. K. Homomixer (Tokushu Kika Kogyo Co., Ltd.).

(Granulation Step)

While holding the temperature of aqueous medium 1 at 70° C. and the rotation rate of the T. K. Homomixer at 12,000 rpm, the polymerizable monomer composition was introduced into the aqueous medium 1 and 9.0 parts of the polymerization initiator Perbutyl PV (10-hour half-life temperature=54.6° C. (NOF Corporation)) was added. Granulation was performed on this for 10 minutes while maintaining 12,000 rpm with the stirrer.

(Polymerization Step)

After the granulation step, the stirrer was changed over to a propeller impeller and polymerization was carried out for 5.0 hours while maintaining 70° C. and stirring at 150 rpm. The temperature was then raised to 85° C. and the polymerization reaction was run by heating for 2.0 hours to obtain a core particle. The temperature of the slurry was cooled to 55° C. and the pH was measured at pH=5.0. While continuing to stir under the same conditions at 55° C., 20.0 parts of the hydrolysis solution of the organosilicon compound for the surface layer was added and formation of the surface layer on the toner particle was started. The surface layer was formed by holding for 30 minutes in this condition, followed by adjusting the pH of the slurry to 9.0 using an aqueous sodium hydroxide solution in order to complete the condensation and holding for an additional 300 minutes.

(Washing and Drying Step)

After the completion of the polymerization step, the toner particle slurry was cooled; hydrochloric acid was added to the toner particle slurry to adjust the pH to 1.5 or below; holding was carried out for 1 hour while stirring; and solid/liquid separation was subsequently performed on a pressure filter to obtain a toner cake. This was reslurried with deionized water to provide another dispersion, followed by solid/liquid separation on the aforementioned filter. Reslurrying and solid-liquid separation were continued until the electrical conductivity of the filtrate became 5.0 S/cm or less, and the final solid-liquid separation provided a toner cake.

The obtained toner cake was dried using a Flash Jet Dryer (Seishin Enterprise Co., Ltd.), an air-current dryer, and the fine powder and the coarse powder were cut using a Coanda effect-based multi-grade classifier to obtain a toner particle 1. The drying conditions were as follows: an injection temperature of 90° C., a dryer outlet temperature of 40° C., and a toner cake feed rate adjusted in conformity with the moisture content of the toner cake to a rate at which the outlet temperature did not deviate from 40° C.

Silicon mapping was performed in TEM observation of toner particle 1, and it was confirmed that the silicon atom was uniformly present in the surface layer. In addition, it was confirmed that the surface layer was not a coating layer formed by the adhesion of silicon compound-containing particulate masses with each other. In this example, an external additive was not externally added to the obtained toner particle 1, and the toner particle 1 was used as such as toner 1.

The methods described below were used in the evaluations that were performed on toner 1. The results obtained from the evaluations of toner 1 are given in Tables 2 and 3.

<Toner Evaluation with LBP>

A modified version of an LBP7600C, a commercial laser printer from Canon, Inc., was used. The modification consisted of altering the main unit of the evaluation machine and the software to enable variable setting of the rotation velocity of the developing roller.

The toner 1 was loaded into a toner cartridge for the LBP7600C. This toner cartridge was held for 24 hours in the environment used in the particular evaluation as given below. The toner cartridge was installed in the LBP7600C after the 24-hour holding period in the indicated environment.

<Evaluation of Development Durability Based on Development Streaks>

Operating in a normal-temperature, normal-humidity environment (25° C., 50% RH), 4,000 prints of an image with a print percentage of 35.0% were printed out on A4 paper in the cross direction. This was followed by printing out a halftone image (toner laid-on level: 0.2 mg/cm$^2$) on letter size XEROX 4200 Paper (Xerox Corporation, 75 g/m$^2$) and evaluation of the development streaks using the criteria given below.

This same evaluation was performed both for a developing roller peripheral velocity of 200 mm/sec, which is a common peripheral velocity, and 300 mm/sec, which is a high speed. The effects of the present invention were considered to be obtained when the evaluation was A or B.

(Evaluation Criteria)

A: Development streaks in the paper discharge direction are not seen on the developing roller or on the image.

B: 1 to 5 thin streaks are seen in the circumferential direction on the developing roller. Or, vertical streaks in the paper discharge direction are seen on the image to a minor degree. However, this is a level that is erased by image processing.

C: 6 to 20 thin streaks are seen in the circumferential direction on the developing roller. Or, several thin streaks are also seen on the image. This is not erased by image processing.

D: 21 or more streaks are seen on the developing roller. Or, one or more substantial streaks or many thin streaks are seen on the image. This is not erased by image processing.

<Evaluation of Development Durability Based on Development Ghosts (Traces of Previous Image)>

Ten prints were continuously made of an image constructed by repeating a 3 cm-wide solid black vertical line and a 3 cm-wide solid white vertical line. This was followed by making one print of a halftone image, and any traces of the previous image remaining on the halftone image were visually discriminated. The image density of the halftone image was adjusted to a reflection density of 0.4 by measuring the reflection density with a MacBeth densitometer (MacBeth Corporation) using an SPI filter.

This same evaluation was performed both for a developing roller peripheral velocity of 200 mm/sec, which is a common peripheral velocity, and 300 mm/sec, which is a high speed. The effects of the present invention were considered to be obtained when the evaluation was A to C.

(Evaluation Criteria)

A: Ghost production does not occur.

B: Minor ghosting is visually observed on a part of the image.

C: Ghosting is visually observed on a part of the image.

D: Ghosting is visually observed over the entire image.

<Low-Temperature Fixability>

The fixing unit was removed from the printer and a length 2.0 cm×width 15.0 cm unfixed toner image (toner laid-on level: 0.9 mg/cm$^2$) was formed on letter size XEROX 4200 paper (75 g/m$^2$, Xerox Corporation) in the region 1.0 cm from the leading edge in the paper transport direction.

The externalized fixing unit was then modified so the fixation temperature and the process speed could be adjusted, and this was used to perform a fixing test on the unfixed image.

Operating in a normal-temperature, normal-humidity environment (23° C., 60% RH) and with the process speed set to 300 mm/s, the unfixed image was fixed at each particular temperature while successively raising the set temperature in 5° C. increments using 150° C. for the initial fixation temperature. The lowest fixation temperature was designated as the fixation temperature at which cold offset was not produced in the resulting fixed image, and the low-temperature fixability was evaluated in accordance with the following criteria. The effects of the present invention were considered to be obtained when the evaluation was A or B.

(Evaluation Criteria)

A: the lowest fixation temperature is equal to or less than 165° C.

B: the lowest fixation temperature is 170° C.

C: the lowest fixation temperature is equal to or greater than 175° C.

Example 2 to Example 19 and Comparative Example 1 to Comparative Example 4

Toners 2 to 23 were produced using the same method as in Example 1, but changing the following as indicated in Table 1: the type and quantity of addition of the wax used, the number of parts of addition of the polymerization initiator, the number of parts of addition of the crosslinking agent, the type of organosilicon compound for the surface layer used in the (Step of Hydrolyzing the Organosilicon Compound for the Surface Layer), the conditions at the time of addition of the hydrolysis solution in the (Polymerization Step), and the holding time after addition. The adjustment of slurry pH was performed using hydrochloric acid and an aqueous sodium hydroxide solution. An organosilicon compound was not added in the case of toner 20. For toners 2 to 23, silicon mapping was also performed as for toner 1 and it was confirmed that the silicon atom was uniformly present in the surface layer and that the surface layer is not a coating layer formed by the adhesion of silicon compound-containing particulate masses with each other. The results of the evaluations of toners 2 to 23 are given in Tables 2 and 3.

TABLE 1

| | Wax | | Type of organosilicon | Parts of polmerization | Parts of crosslinking | Conditions at the time of addition of the hydrolysis solution | | | Condition after addition of hydrolysis solution Holding time (min) |
|---|---|---|---|---|---|---|---|---|---|
| | Parts | Type | compound | initiator | agent | Slurry pH | Slurry temperature (° C.) | Parts of hydrolysis solution | until pH adjustment for completion of condensation |
| Toner 1 | 15.0 | Ethyleneglycol distearate | Methyltriethoxysilane | 9.0 | 0.3 | 5.0 | 55 | 20.0 | 30 |
| Toner 2 | 7.0 | Ethyleneglycol distearate | Methyltriethoxysilane | 9.0 | 0.3 | 5.0 | 55 | 20.0 | 30 |
| Toner 3 | 19.0 | Ethyleneglycol distearate | Methyltriethoxysilane | 9.0 | 0.3 | 5.0 | 55 | 20.0 | 30 |
| Toner 4 | 5.0 | Ethyleneglycol distearate | Methyltriethoxysilane | 9.0 | 0.3 | 5.0 | 55 | 12.5 | 30 |
| Toner 5 | 18.0 | Ethyleneglycol distearate | Methyltriethoxysilane | 9.0 | 0.3 | 5.0 | 55 | 20.0 | 30 |
| Toner 6 | 20.0 | Ethyleneglycol distearate | Methyltriethoxysilane | 9.0 | 0.3 | 5.0 | 55 | 20.0 | 30 |
| Toner 7 | 15.0 | Ethyleneglycol distearate | Methyltriethoxysilane | 9.0 | 0.3 | 9.5 | 75 | 20.0 | 0 |
| Toner 8 | 15.0 | Ethyleneglycol distearate | Methyltriethoxysilane | 9.0 | 0.3 | 9.0 | 70 | 20.0 | 0 |
| Toner 9 | 15.0 | Ethyleneglycol distearate | Methyltriethoxysilane | 9.0 | 0.3 | 5.0 | 40 | 20.0 | 90 |
| Toner 10 | 15.0 | Ethyleneglycol distearate | Methyltriethoxysilane | 9.0 | 0.3 | 9.0 | 70 | 20.0 | 0 |
| Toner 11 | 15.0 | Ethyleneglycol distearate | Propyltriethoxysilane | 9.0 | 0.3 | 5.0 | 55 | 20.0 | 30 |
| Toner 12 | 15.0 | Ethyleneglycol distearate | Hexyltriethoxysilane | 9.0 | 0.3 | 5.0 | 55 | 20.0 | 30 |
| Toner 13 | 15.0 | Ethyleneglycol dipalmitate | Methyltriethoxysilane | 9.0 | 0.3 | 5.0 | 55 | 20.0 | 30 |
| Toner 14 | 15.0 | Distearyl sebacate | Methyltriethoxysilane | 9.0 | 0.3 | 5.0 | 55 | 20.0 | 30 |
| Toner 15 | 15.0 | Dibehenyl adipate | Methyltriethoxysilane | 9.0 | 0.3 | 5.0 | 55 | 20.0 | 30 |
| Toner 16 | 7.0 | Ethyleneglycol distearate | Methyltriethoxysilane | 9.0 | 0.3 | 5.0 | 55 | 37.5 | 30 |
| Toner 17 | 10.0 | Ethyleneglycol distearate | Methyltriethoxysilane | 9.0 | 0.3 | 5.0 | 55 | 37.5 | 30 |
| Toner 18 | 20.0 | Ethyleneglycol distearate | Methyltriethoxysilane | 9.0 | 0.3 | 5.0 | 55 | 12.5 | 30 |
| Toner 19 | 25.0 | Ethyleneglycol distearate | Methyltriethoxysilane | 9.0 | 0.3 | 5.0 | 55 | 12.5 | 30 |
| Toner 20 | 15.0 | Ethyleneglycol distearate | — | 9.0 | 0.3 | — | — | — | — |
| Toner 21 | — | — | Methyltriethoxysilane | 9.0 | 0.3 | 5.0 | 55 | 20.0 | 30 |
| Toner 22 | 15.0 | Ethyleneglycol distearate | Methyltriethoxysilane | 7.0 | 0.7 | 5.0 | 55 | 20.0 | 30 |
| Toner 23 | 15.0 | Glycerol tribehenate | Methyltriethoxysilane | 9.0 | 0.3 | 5.0 | 55 | 20.0 | 30 |

TABLE 2

| | Organosilicon polymer | | | | | | | | | | Number-average | Weight-average |
|---|---|---|---|---|---|---|---|---|---|---|---|---|
| | Content (mass %) | Average thickness Dav. (nm) | *1 | *2 | Rate of increase A | Rate of increase B | B − A | X (mass %) | X/Y | Martens hardness (MPa) | particle diameter D1 (μm) | particle diameter D4 (μm) |
| Toner 1 | 2.6 | 39.3 | 0.40 | 0.19 | 64 | 214 | 150 | 15.0 | 5.7 | 610 | 6.12 | 6.91 |
| Toner 2 | 2.3 | 39.4 | 0.34 | 0.34 | 105 | 156 | 51 | 7.0 | 3.0 | 700 | 6.12 | 6.91 |
| Toner 3 | 2.3 | 39.3 | 0.42 | 0.12 | 49 | 244 | 196 | 19.0 | 8.3 | 623 | 6.16 | 6.96 |
| Toner 4 | 1.0 | 11.2 | 0.39 | 0.38 | 69 | 142 | 72 | 5.0 | 5.0 | 430 | 6.12 | 6.92 |
| Toner 5 | 2.3 | 39.3 | 0.42 | 0.14 | 49 | 237 | 189 | 18.0 | 7.8 | 618 | 6.12 | 6.92 |
| Toner 6 | 2.3 | 39.5 | 0.39 | 0.10 | 69 | 252 | 183 | 20.0 | 8.7 | 623 | 6.13 | 6.93 |
| Toner 7 | 2.3 | 43.1 | 0.31 | 0.19 | 125 | 215 | 90 | 15.0 | 6.5 | 185 | 6.19 | 6.99 |
| Toner 8 | 2.3 | 42.1 | 0.31 | 0.19 | 128 | 215 | 87 | 15.0 | 6.5 | 203 | 6.17 | 6.97 |
| Toner 9 | 2.3 | 21.5 | 0.36 | 0.19 | 92 | 215 | 123 | 15.0 | 6.5 | 1092 | 6.15 | 6.95 |
| Toner 10 | 2.3 | 42.1 | 0.32 | 0.19 | 123 | 215 | 92 | 15.0 | 6.5 | 1200 | 6.11 | 6.90 |
| Toner 11 | 2.3 | 39.3 | 0.33 | 0.19 | 116 | 215 | 99 | 15.0 | 6.5 | 423 | 6.12 | 6.91 |

TABLE 2-continued

| | Organosilicon polymer | | | | | | | | | | Number-average | Weight-average |
|---|---|---|---|---|---|---|---|---|---|---|---|---|
| | Content (mass %) | Average thickness Dav. (nm) | *1 | *2 | Rate of increase A | Rate of increase B | B − A | X (mass %) | X/Y | Martens hardness (MPa) | particle diameter D1 (μm) | particle diameter D4 (μm) |
| Toner 12 | 2.3 | 39.5 | 0.32 | 0.19 | 117 | 215 | 98 | 15.0 | 6.5 | 328 | 6.12 | 6.92 |
| Toner 13 | 2.3 | 39.2 | 0.38 | 0.29 | 76 | 178 | 102 | 15.0 | 6.5 | 585 | 6.17 | 6.97 |
| Toner 14 | 2.3 | 39.3 | 0.37 | 0.21 | 82 | 208 | 125 | 15.0 | 6.5 | 597 | 6.10 | 6.89 |
| Toner 15 | 2.3 | 39.3 | 0.37 | 0.30 | 85 | 171 | 86 | 15.0 | 6.5 | 599 | 6.14 | 6.94 |
| Toner 16 | 3.2 | 62.8 | 0.34 | 0.34 | 105 | 156 | 51 | 7.0 | 2.2 | 702 | 6.13 | 6.93 |
| Toner 17 | 3.2 | 62.4 | 0.34 | 0.29 | 109 | 178 | 69 | 10.0 | 3.1 | 695 | 6.16 | 6.96 |
| Toner 18 | 1.0 | 11.6 | 0.32 | 0.11 | 117 | 248 | 130 | 20.0 | 20.0 | 410 | 6.10 | 6.89 |
| Toner 19 | 1.0 | 11.2 | 0.29 | 0.10 | 139 | 289 | 149 | 25.0 | 25.0 | 401 | 6.12 | 6.91 |
| Toner 20 | — | — | 0.31 | 0.36 | 131 | 146 | 15 | 15.0 | — | 69 | 6.13 | 6.93 |
| Toner 21 | 3.0 | 39.3 | 0.49 | 0.24 | 115 | 116 | 1 | — | — | 310 | 6.17 | 6.97 |
| Toner 22 | 2.3 | 39.5 | 0.48 | 0.19 | 9 | 215 | 206 | 15.0 | 6.5 | 633 | 6.14 | 6.94 |
| Toner 23 | 2.3 | 39.3 | 0.33 | 0.41 | 112 | 127 | 15 | 15.0 | 6.5 | 600 | 6.10 | 6.89 |

*1: Force (mN) applied to the toner particle when a percentage deformation of the toner particle with reference to a number-average particle diameter of the toner particle at 25° C. reaches 15%, in a measurement performed in a microcompression test under a maximum load condition of $1.1 \times 10^{-3}$N.
*2: Force (mN) applied to the toner particle when a percentage deformation of the toner particle with reference to a number-average particle diameter of the toner particle at 45° C. reaches 15%, in a measurement performed in a microcompression test under a maximum load condition of $1.1 \times 10^{-3}$N.

TABLE 3

| | | Development streaks | | Development ghosts | | Low-temperature fixability | |
|---|---|---|---|---|---|---|---|
| | | Developing roller peripheral velocity | | Developing roller peripheral velocity | | Lowest fixation temperature | |
| | | 200 mm/sec | 300 mm/sec | 200 mm/sec | 300 mm/sec | (° C.) | Rank |
| Example 1 | Toner 1 | A | A | A | A | 160 | A |
| Example 2 | Toner 2 | A | A | A | A | 165 | A |
| Example 3 | Toner 3 | A | B | A | B | 160 | A |
| Example 4 | Toner 4 | A | A | A | A | 170 | B |
| Example 5 | Toner 5 | A | A | A | A | 160 | A |
| Example 6 | Toner 6 | A | B | A | B | 160 | A |
| Example 7 | Toner 7 | A | B | A | B | 160 | A |
| Example 8 | Toner 8 | A | A | A | A | 160 | A |
| Example 9 | Toner 9 | A | A | A | A | 160 | A |
| Example 10 | Toner 10 | A | B | A | A | 165 | A |
| Example 11 | Toner 11 | A | A | A | A | 160 | A |
| Example 12 | Toner 12 | A | A | A | A | 160 | A |
| Example 13 | Toner 13 | A | A | A | A | 160 | A |
| Example 14 | Toner 14 | A | A | A | A | 160 | A |
| Example 15 | Toner 15 | A | A | A | A | 165 | A |
| Example 16 | Toner 16 | A | A | A | A | 165 | A |
| Example 17 | Toner 17 | A | A | A | A | 160 | A |
| Example 18 | Toner 18 | A | A | A | A | 160 | A |
| Example 19 | Toner 19 | A | B | A | A | 160 | A |
| Comparative Example 1 | Toner 20 | C | D | C | D | 155 | A |
| Comparative Example 2 | Toner 21 | A | A | A | A | 175 | C |
| Comparative Example 3 | Toner 22 | A | C | A | A | 160 | A |
| Comparative Example 4 | Toner 23 | A | A | A | A | 175 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-197730, filed Oct. 19, 2018, which is hereby incorporated by reference herein in its entirety.

What is claimed is:

1. A toner comprising a toner particle, said toner particle comprising a core particle and a surface layer thereon;

the surface layer containing an organosilicon polymer;

the core particle containing a binder resin and an ester wax; and said ester wax being represented by formulae (3) or (4)

(3)

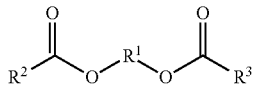

-continued (4)

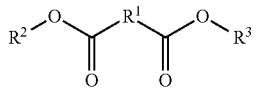

where $R^1$ represents an alkylene group having from 1 to 6 carbons, and $R^2$ and $R^3$ independently represent a linear alkyl group having from 11 to 25 carbons, wherein in a microcompression test performed on 100 toner particles using a flat indenter of 0.014 mN/μm under a condition of a maximum load of $1.1\times10^{-3}$N, with an amount of indention set to 60 μm and a displacement velocity of the indenter set to 0.2 μm/s, a force applied to the toner particle when a percentage deformation of the toner particle with reference to a number-average particle diameter of the toner particle at 25° C. reaches 15% is 0.10 to 1.00 mN and the force applied to the toner particle when the percentage deformation at 45° C. reaches 15% is 0.10 to 0.40 mN, and $50\leq B-A\leq 200$ when the force applied to the toner particle is a variable and the percentage deformation of the toner particle is from 15% to 30%, A is the rate of increase in the percentage deformation of the toner particle at 25° C., and B is the rate of increase in the percentage deformation of the toner particle at 45° C.

2. The toner according to claim 1, wherein B is 150 to 250.

3. The toner according to claim 1, wherein the toner particle has a Martens hardness of 200 to 1100 MPa measured in a microcompression test under a maximum load condition of $2.0\times10^{-4}$ N.

4. The toner according to claim 1, wherein the organosilicon polymer has a substructure represented by $R—SiO_{3/2}$ where R represents a hydrocarbon group having from 1 to 10 carbons.

5. The toner according to claim 1, wherein $3.0\leq(X/Y)\leq30.0$ when X (mass %) is a content of the wax with reference to a total mass of the toner particle and Y (mass %) is a content of the organosilicon polymer contained in the surface layer.

6. The toner according to claim 1, wherein the content of the wax with reference to the total mass of the toner particle is 5.0 to 32.0 mass %.

7. The toner according to claim 1, wherein the surface layer has an average thickness of 5.0 to 70.0 nm.

* * * * *